US006688693B2

(12) United States Patent
Christofferson et al.

(10) Patent No.: US 6,688,693 B2
(45) Date of Patent: Feb. 10, 2004

(54) SEAT BACK ASSEMBLY

(75) Inventors: James L. Christofferson, Longmont, CO (US); Sharon L. Pratt, Longmont, CO (US); Allen B. Killebrew, Longmont, CO (US); Bryan J. Griffiths, Littleton, CO (US)

(73) Assignee: Sunrise Medical HHG Inc., Longmont, CO (US)

( * ) Notice: Subject to any disclaimer, the term of this patent is extended or adjusted under 35 U.S.C. 154(b) by 0 days.

(21) Appl. No.: 10/044,298

(22) Filed: Oct. 19, 2001

(65) Prior Publication Data

US 2003/0030318 A1 Feb. 13, 2003

Related U.S. Application Data

(63) Continuation-in-part of application No. 09/676,917, filed on Oct. 2, 2000, now abandoned.

(51) Int. Cl.[7] ..... A47C 7/42

(52) U.S. Cl. ..... 297/354.12; 297/284.3; 297/363; 297/440.2

(58) Field of Search ..... 297/284.1, 284.3, 297/354.12, 363, 364, 440.2

(56) References Cited

U.S. PATENT DOCUMENTS

| | | | | | |
|---|---|---|---|---|---|
| 2,771,124 | A | * | 11/1956 | Borsani | 297/313 |
| 4,555,121 | A | * | 11/1985 | Lockard et al. | 280/30 |
| 4,647,066 | A | * | 3/1987 | Walton | 297/284.1 |
| 4,981,325 | A | * | 1/1991 | Zacharkow | 297/284.1 |
| 5,035,467 | A | * | 7/1991 | Axelson et al. | 297/440.22 |
| 5,062,677 | A | * | 11/1991 | Jay et al. | 297/440.2 |
| 5,127,709 | A | * | 7/1992 | Rubinstein et al. | 297/440.2 |
| 5,228,747 | A | * | 7/1993 | Greene | 297/284.3 |
| 5,297,021 | A | * | 3/1994 | Koerlin et al. | 700/56 |
| 5,364,162 | A | * | 11/1994 | Bar et al. | 297/284.8 |
| 5,407,248 | A | * | 4/1995 | Jay et al. | 297/284.1 |
| 5,551,756 | A | * | 9/1996 | Gurasich et al. | 297/440.2 |
| 5,556,168 | A | * | 9/1996 | Dinsmoor et al. | 297/440.2 |
| 5,593,211 | A | * | 1/1997 | Jay et al. | 297/383 |
| 5,647,637 | A | * | 7/1997 | Jay et al. | 297/354.12 |
| 5,848,824 | A | * | 12/1998 | Mocur | 297/440.2 |
| 5,906,416 | A | * | 5/1999 | Rasmussen | 297/452.33 |
| 5,944,385 | A | * | 8/1999 | Pearce | 297/354.12 |
| 6,095,611 | A | * | 8/2000 | Bar et al. | 297/440.21 |
| 6,257,664 | B1 | | 7/2001 | Chew et al. | |
| 6,378,947 | B1 | * | 4/2002 | Barber et al. | 297/452.25 |

FOREIGN PATENT DOCUMENTS

| | | |
|---|---|---|
| DE | 93 17 020.3 | 11/1993 |
| DE | 299 22 030 | 12/1999 |
| WO | WO 92/14387 | 9/1992 |

* cited by examiner

*Primary Examiner*—Peter M. Cuomo
*Assistant Examiner*—Joseph Edell
(74) *Attorney, Agent, or Firm*—MacMillan, Sobanski & Todd, LLC

(57) ABSTRACT

A seat back assembly for connecting a seat back shell to the seat back tubes of a wheelchair comprises a shell, upper and lower shell connectors, and upper and lower side plate portions. The lower shell connector is mounted to a lower portion of the shell. The upper shell connector is mounted to an upper portion of the shell. The upper side plate portion is adapted to be mounted to an upper portion of the seat back tube. The lower side plate portion is adapted to be mounted to a lower portion of the seat back tube at a position substantially co-linear to the posterior superior illiac spine (PSIS) of a user. The lower shell connector and the lower side plate portion are pivotally engageable with one another along a pivot axis. The upper shell connector and the upper side plate portion are attachable relative to one another at discrete locations so as to permit the angular disposition of the shell to be adjusted.

13 Claims, 12 Drawing Sheets

SEAT BACK ASSEMBLY

CROSS-REFERENCE TO RELATED APPLICATIONS

This application is a continuation-in-part of U.S. patent application Ser. No. 09/676,917, filed on Oct. 2, 2000 now abandoned.

BACKGROUND OF THE INVENTION

This invention relates in general to chairs and more particularly, to wheelchairs. Most particularly, the invention relates to wheelchair seat backs that are movable and flexible to accommodate an increased load capacity.

The anatomy and biomechanics of the human spine with normal neuromuscular function could be described as having an anterior curve in the lumbar area, a posterior curve in the thoracic area, and an anterior curve in the cervical area. When a person is in a seated position, large muscle groups, for example, the abdominal muscles and the spinal extensors, work hard in harmony to hold the body in a state of balance. The pelvis provides a support foundation, upon which the spine and the head are balanced.

When a person is in a seated position, the pelvis needs to be neutral or in a slightly anterior position in order for the spine and head to be in their most stable and therefore functional position. Three conditions affect the needs of the pelvis when a person is seated in a conventional seat.

First, the pelvis encounters posterior tilt or rocks backwards. When the pelvis rocks backwards, the spinal curves change. For example, the thoracic spine curvature increases, or becomes kyphotic, and the lumbar spine flattens or loses its anterior curve. This is not a desirable position for safety, function or skin protection. Therefore, it is desirable to block the posterior pelvis so as to prevent posterior rocking of the pelvis, which will happen if the pelvis is unsupported due to the effects of gravity and fatigue of the major muscle groups.

Second, the back tends to flatten. The thoracic spine has a natural posterior curve. A flat back does not support a functional posture. Moreover, it causes fatigue. To prevent the muscles from having to work too hard and ultimately fatiguing, the spine needs to be supported accordingly.

Third, the gluteal mass or soft tissue tends to spread in a posterior curve below a hinge point of the seat back. When unaccommodated by a back support, this causes the person to slide forward in the seat and consequently lose posterior pelvic contact with the seat back, which further causes undesirable posterior pelvic tilt.

What is needed is a seat back assembly that will solve the above-identified problems by blocking the posterior pelvis at the level of the anatomic hinge point in the spine with a back support hinge that lines up with the anatomic hinge. The seat back assembly should extend posteriorly above the hinge point to accommodate the natural curvature and biomechanics of the spine. Moreover, it should flare posteriorly beneath the hinge point to accommodate the curvature of the gluteal mass or soft tissue.

SUMMARY OF THE INVENTION

The present invention is directed towards a seat back assembly for connecting a seat back shell to the seat back tubes of a wheelchair. The seat back assembly comprises a shell, upper and lower shell connectors, and upper and lower side plate portions. The lower shell connector is mounted to a lower portion of the shell. The upper shell connector is mounted to an upper portion of the shell. The upper side plate portion is adapted to be mounted to an upper portion of the seat back tube. The lower side plate portion is adapted to be mounted to a lower portion of the seat back tube at a position substantially co-linear to the posterior superior illiac spine (PSIS) of a user. The lower shell connector and the lower side plate portion are pivotally engageable with one another along a pivot axis. The upper shell connector and the upper side plate portion are attachable relative to one another at discrete locations so as to permit the angular disposition of the shell to be adjusted.

Another embodiment of the invention is directed towards a wheelchair comprising a seat back tube and a seat back assembly. The seat back assembly comprises a shell, a lower shell connector, and upper shell connector and a side plate. The lower shell connector is mounted to a lower portion of the shell. The upper shell connector is mounted to an upper portion of the shell. The side plate comprises an upper side plate portion and a lower side plate portion. The upper side plate portion is adapted to be mounted to an upper portion of the seat back tube. The lower side plate portion adapted to be mounted to a lower portion of the seat back tube at a position substantially co-linear to the PSIS of a user. The lower shell connector and the lower side plate portion are pivotally engageable with one another. The upper shell connector and the upper side plate portion are attachable relative to one another at discrete locations so as to permit the angular disposition of the shell to be adjusted.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
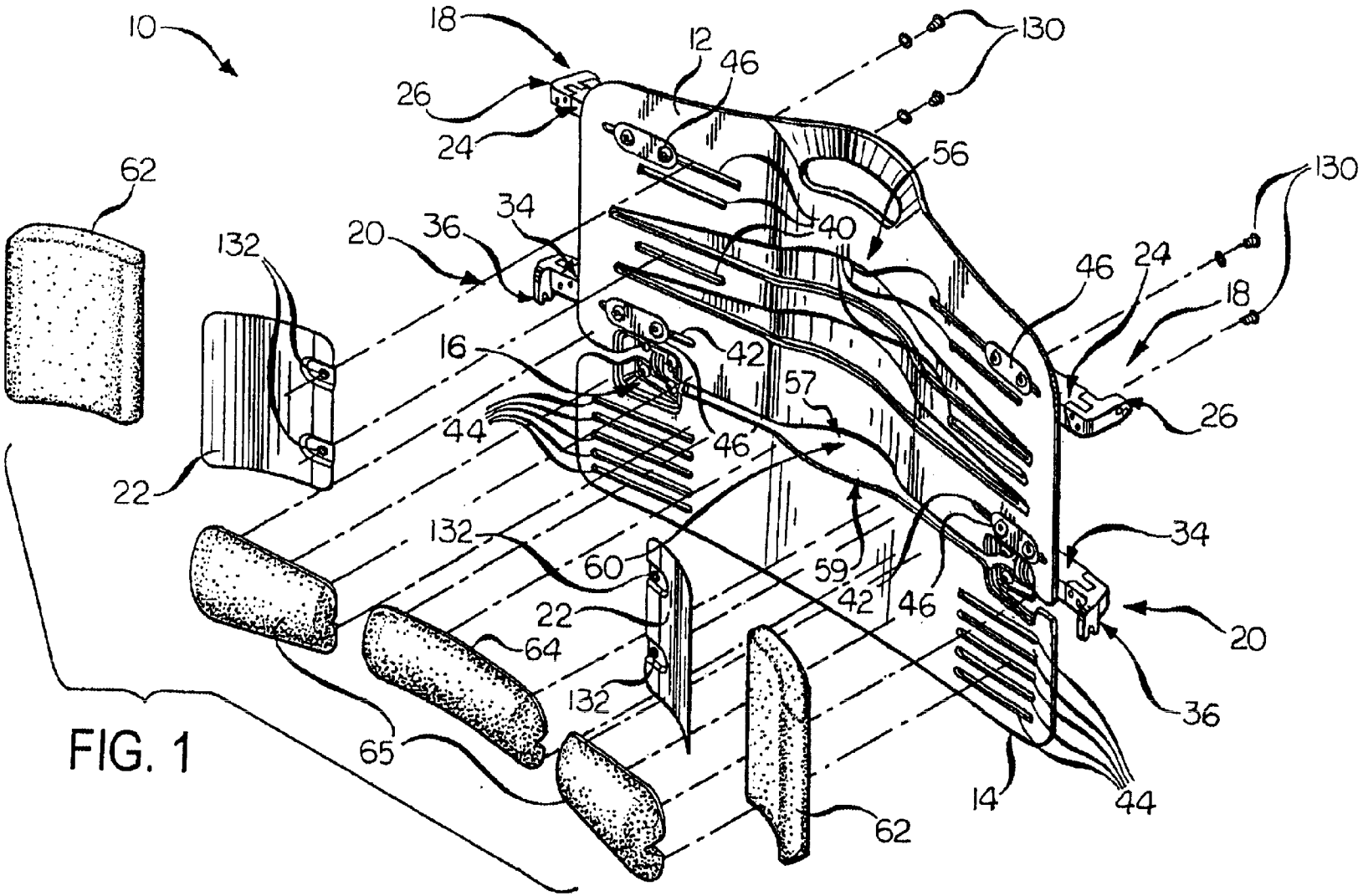
FIG. 1 is an exploded perspective view of a wheelchair seat back assembly.
Figure 2:
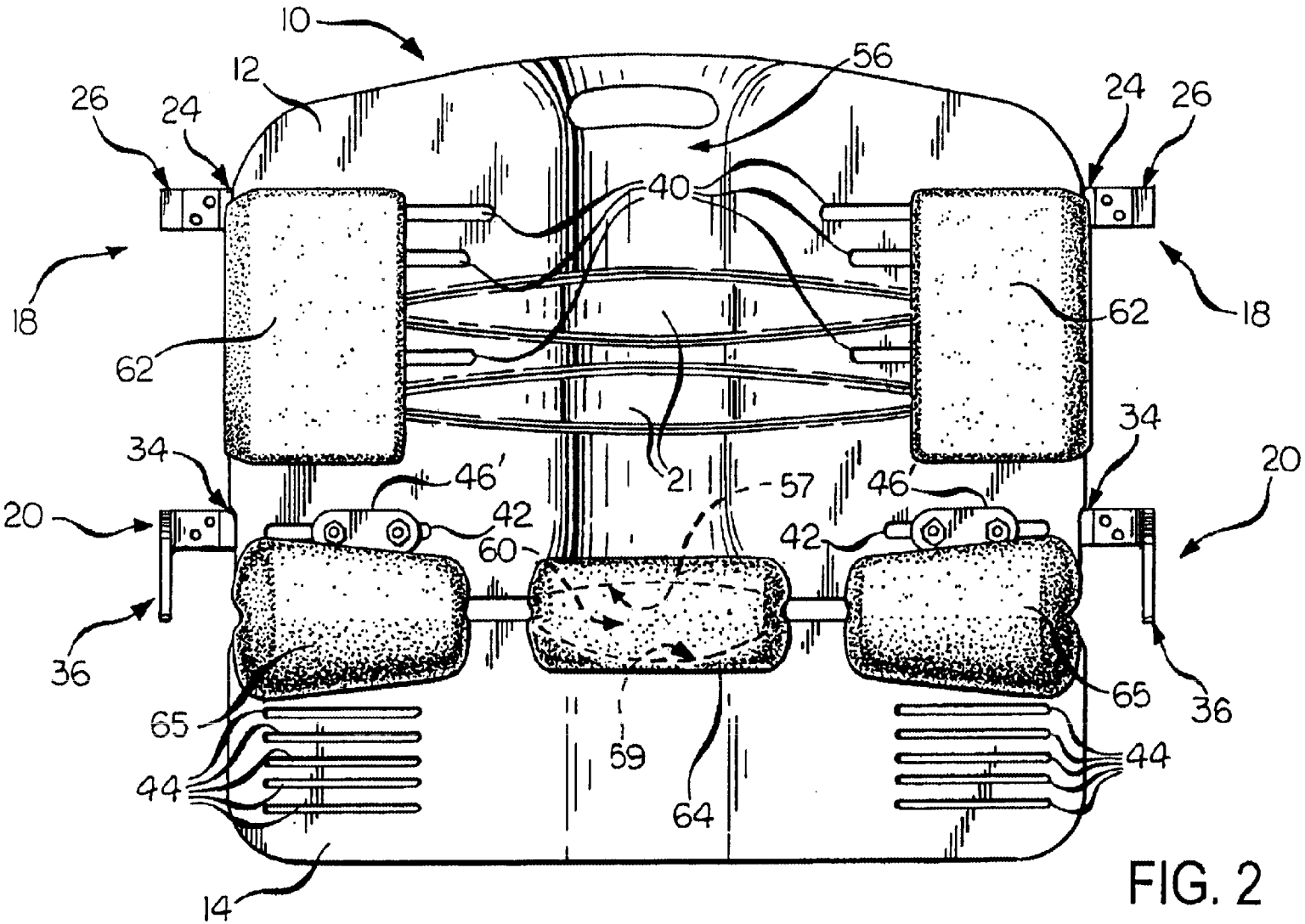
FIG. 2 is a front elevational view of the seat back assembly shown in FIG. 1.
Figure 3:
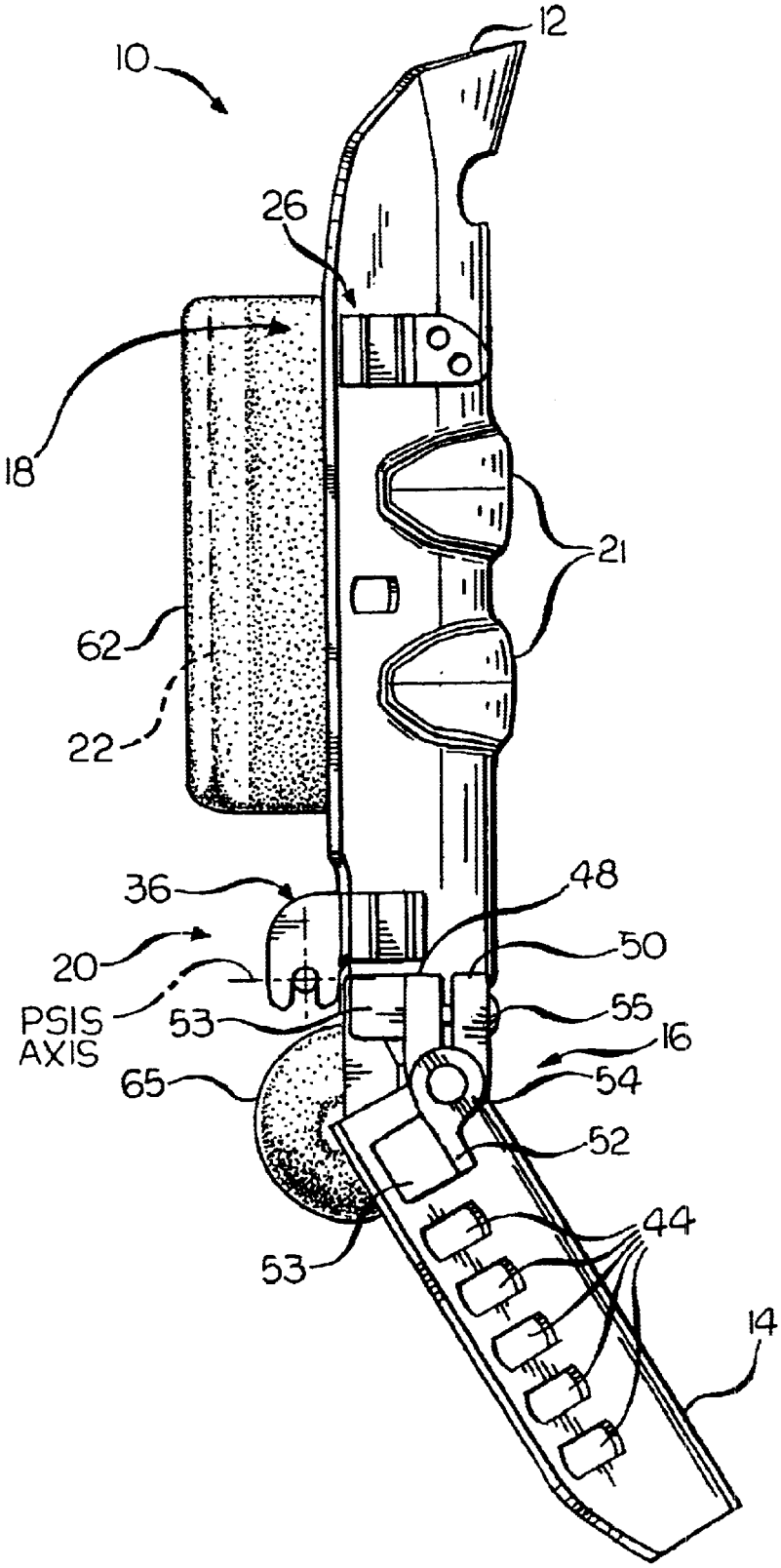
FIG. 3 is a side elevational view of the seat back assembly shown in FIGS. 1 and 2.

Referring now to the drawings, there is illustrated in FIGS. 1–3 a wheelchair seat back assembly 10. The seat back assembly 10 preferably comprises a seat back shell 12 and a vanity flap 14. The shell 12 and the vanity flap 14 are pivotally connected together by one or more hinges 16. The shell 12 and the vanity flap 14 are adapted to be mounted to wheelchair seat back tubes T (shown in FIGS. 7 and 8). The shell 12 and the vanity flap 14 are adapted to be mounted by upper and lower shell connectors 18, 20. The upper shell connectors 18 are attached to opposing upper side portions of the shell 12. The lower shell connectors 20 are attached to opposing lower side portions of the shell 12. The upper and lower shell connectors 18, 20 are preferably laterally adjustable to accommodate wheelchairs of varying widths. The shell connectors 18, 20 are vertically adjustable to position the hinges 16 adjacent to lower mounting points on wheelchair seat back tubes T. The lower mounting points are adapted to be positioned in line with the posterior superior illiac spine (PSIS) of a user when the user is seated in the wheelchair against the seat back assembly 10. The hinges 16, the lower mounting points, and the PSIS of a user all roughly line up to allow the user's pelvis to be oriented separately from the rest of the seat back assembly 10. To accommodate wheelchairs that are wider than the shell 12 and the vanity flap 14 and to provide extra support and stability for the upper trunk or torso of the user, growth plates 22 may be attached to the shell 12 and the vanity flap 14. The growth plates 22 of varying shape and dimension may be employed.

Now, continuing with reference to FIGS. 1–3, the seat back assembly 10 will be described in greater detail. As shown in the drawings, the shell 12 may be primarily dish-shaped in construction. That is to say, the overall general contour of the shell 12 is preferably concave to conform to the general shape of the user's back. The shell 12 is preferably made of a flexible material and thus may be provided with reinforcement members, such as the reinforcement members 21 shown. The contour of the shell 12 affects the location of the lower connectors 20 relative to the PSIS of the user. Hence, it should be considered when determining the dimensions of lower shell connectors 20. It is also preferable that the shell 12 be provided with a central region defined by a concave relief 56. The relief 56 is adapted to receive the spine of the user. Moreover, the relief 56 increases the structural integrity of the shell 12.

The vanity flap 14 may have a shape complementary to the shape of the shell 12. Accordingly, the vanity flap 14 likewise may be primarily dish-shaped in construction. In addition to conforming to the general shape of the user's back, receiving the spine of the user, and having an increased structural integrity, the complementary shape of the vanity flap 14 would be aesthetically pleasing to the user.

The shell 12 and the vanity flap 14 may each have a central cutaway region 57, 59 that cooperatively define an opening, generally indicated at 60, between the shell 12 and the vanity flap 14. More particularly, the opening 60 may be defined between central cutaway regions 57, 59 provided at a lower portion of the shell 12 and an upper portion of the vanity flap 14. The opening 60 is provided to reduce the risk that the shell 12, the vanity flap 14 and the adjacent concave relief 56 will contact one another throughout hinged movement of the vanity flap 14.

Figure 4:
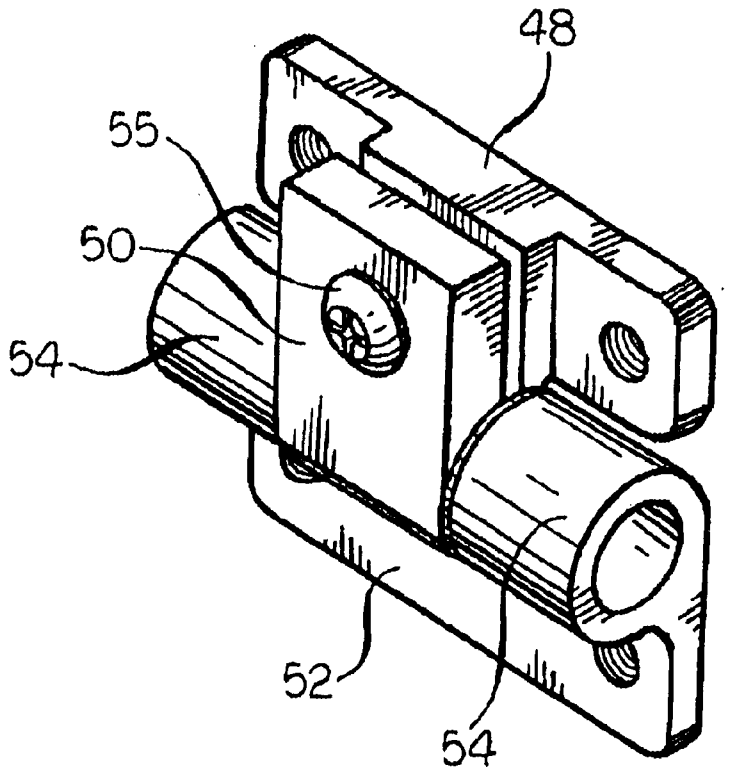
FIG. 4 is an enlarged perspective view of a hinge of the seat back assembly shown in FIG. 1

Each hinge 16 may include two members, namely, an upper member and a lower member. As shown in FIG. 4, the upper member may be comprised of a mounting plate 48 and a single hinge plate 50 integral with the mounting plate 48. The lower member may be comprised of a mounting plate 52 and a pair of laterally spaced hinge plates 54 integral with the mounting plate 52. The mounting plates 48, 52 are adapted to be secured to the shell 12 and the vanity flap 14. It may be necessary to shim the mounting plates 48, 52, such as with the shims 53, 53' shown, to align the hinges 16 along a lateral axis if the shell 12 is dish-shaped in construction. The single hinge plate 50 is adapted to be inserted and secured between the laterally spaced hinge plates 54 and held in position relative to the laterally spaced hinge plates 54 by a hinge pin (not shown). A fastener 55 is adapted to be loosened to permit the single hinge plate 50 to pivot, which allows the angular relationship between the shell 12 and the vanity flap 14 to be adjusted. Once a desired angular relationship is achieved, the fastener 55 may be tightened to prevent the vanity flap 14 from moving relative to the shell 12. The hinges 16 are provided to permit the vanity flap 14 to be adjusted relative to the shell 12. Once adjusted to a desired position, the hinges 16 are adapted to be secured in a non-pivotal or fixed position to maintain the vanity flap 14 in the desired position.

Figure 5:
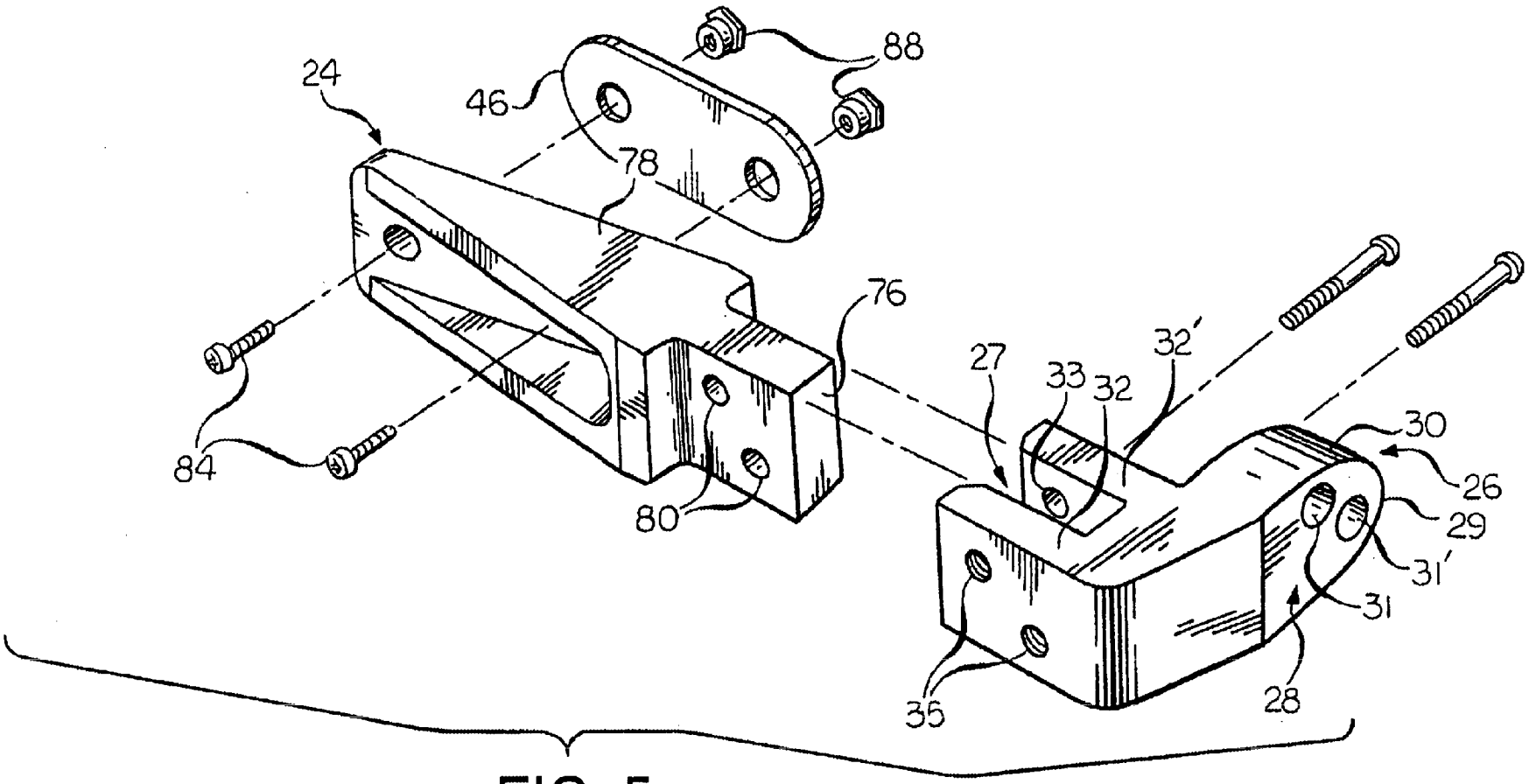
FIG. 5 is an exploded perspective view of an upper shell connector.

Each upper shell connector 18 has two members joined at a right angle. As shown in FIG. 5, one member defines a coupling element 26. The other member defines a mortise 27. The coupling element 26 may include a vertically and longitudinally extending plate 28 at its rearward end and a tapered side clearance surface at its forward end. The plate 28 has a blunt rearward tip 29 and a curved rearward upper clearance surface 30. Diagonally disposed through holes 31, 31' extend laterally through the plate 28. The mortise 27 is defined between two laterally extending legs 32, 32'. One leg 32 is provided with longitudinally extending through holes 33. The other leg 32' is provided with longitudinally extending threaded apertures 35. The through holes 33 are preferably arranged diagonally relative to one another, as are the threaded apertures 35. Moreover, the through holes 33 are arranged co-axially with the threaded apertures 35.

Figure 6:
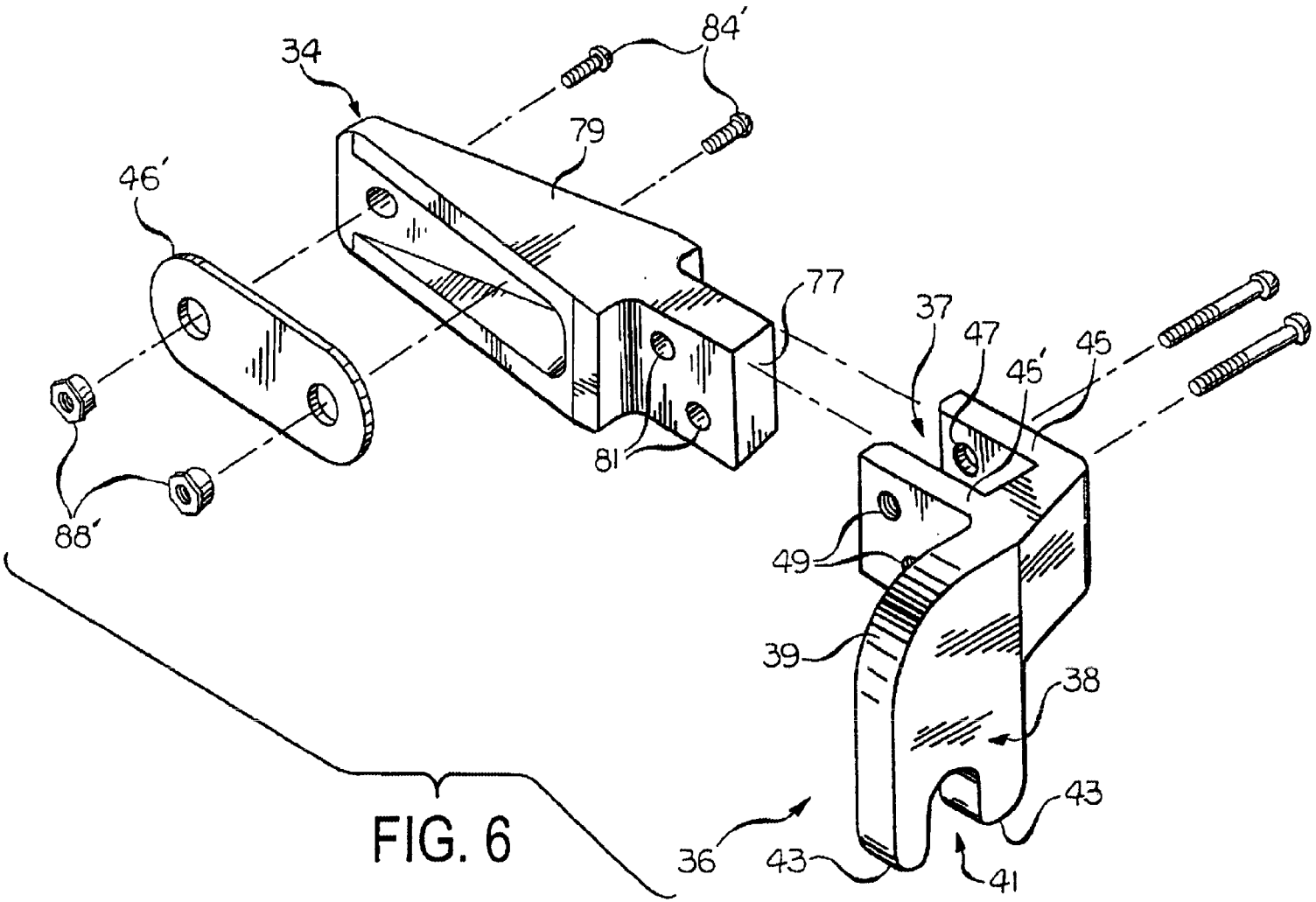
FIG. 6 is an exploded perspective view of a lower shell connector.

Like the upper shell connector 18, each lower shell connector 20 also has two members joined at a right angle. One member defines a coupling element 36 and the other member defines a mortise 37, as shown in FIG. 6. The coupling element 36 may include a vertically and longitudinally extending plate 38 at its rearward end and a tapered side clearance surface at its forward end. The plate 38 has a curved rearward upper clearance surface 39 and an opening 41 in a lower end. The opening 41 is partially defined between two lower curved clearance surfaces 43 and has a generally semi-cylindrical shape. The mortise 37 is defined between two laterally extending legs 45, 45'. One leg 45 is provided with longitudinally extending through holes 47. The other leg 45' is provided with longitudinally extending threaded apertures 49. The through holes 47 are preferably arranged diagonally relative to one another, as are the threaded apertures 49. Moreover, the through holes 47 are arranged co-axially with the threaded apertures 49.

The mortise 27, 37 of each connector 18, 20 described above is adapted to receive a laterally extending tenon 76, 77 to form a joint. The tenon 76, 77 is an integral part of a shell mount 24, 34. Each shell mount 24, 34 further has a main body 78, 79 having a pair of spaced apart through bores 80, 81 therein. The main body 78, 79 is adapted to be attached to the back of the shell 12. The main body 78, 79 may be tapered, as shown, to compensate for the dish-shaped construction of the shell 12. In the preferred embodiment of the invention, the main body 78, 79 is adjustably attached to the shell 12 so that it can be adjusted in lateral and vertical directions.

The shell mounts 24, 34 may be adjustably attached in any suitable manner. For example, a plurality of vertically spaced, laterally extending slots 40, 42 (shown in FIGS. 1 and 2) may be provided in the shell 12. Similar slots 44 may be provided in the vanity flap 14. Certain of these slots 40, 42 may be provided for attaching the shell mounts 24, 34 to the shell 12. These slots 40, 42 may permit lateral adjustment of the shell mounts 24, 34. The slots 40, 42 may also permit vertical adjustment of the shell mounts 24, 34. The shell mounts 24, 34 may be attached to the shell 12 with fasteners 84, 84', such as the button-head cap screws shown in FIGS. 5 and 6. The fasteners 84, 84' may be inserted through the through bores 80, 81 in the main body 78, 79 and desired slots 40, 42 and then threadably engaged with threaded sleeves 88, 88' in mounting plates 46, 46'. The shell mounts 24, 34 and mounting plates 46, 46' may be displaced laterally by loosening the fasteners 84, 84' and vertically by removing the fasteners 84, 84' and inserting the fasteners 84, 84' in different slots.

Figure 7:
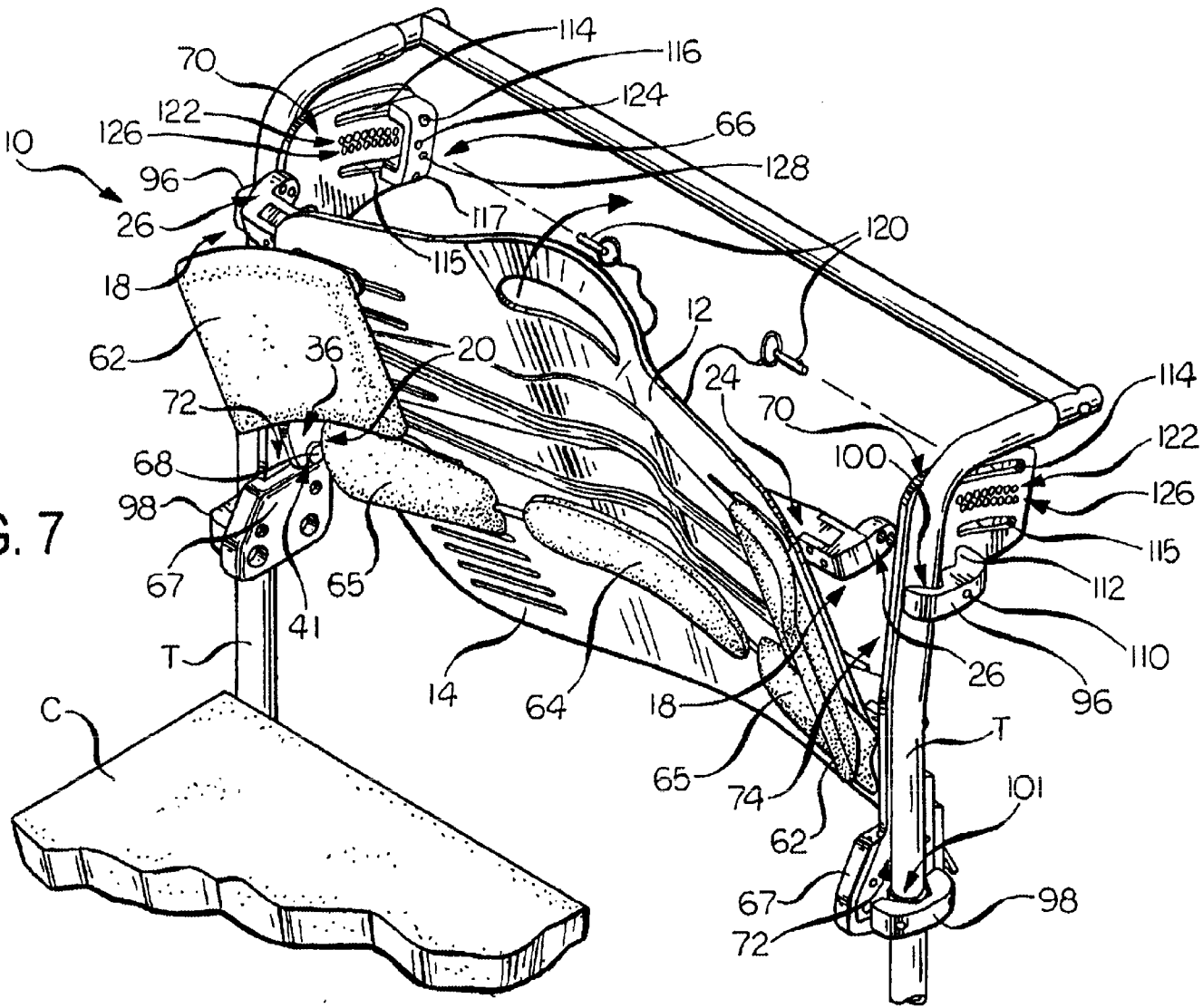
FIG. 7 is a perspective view of the seat back assembly partially attached to wheelchair seat back tubes.
Figure 8:
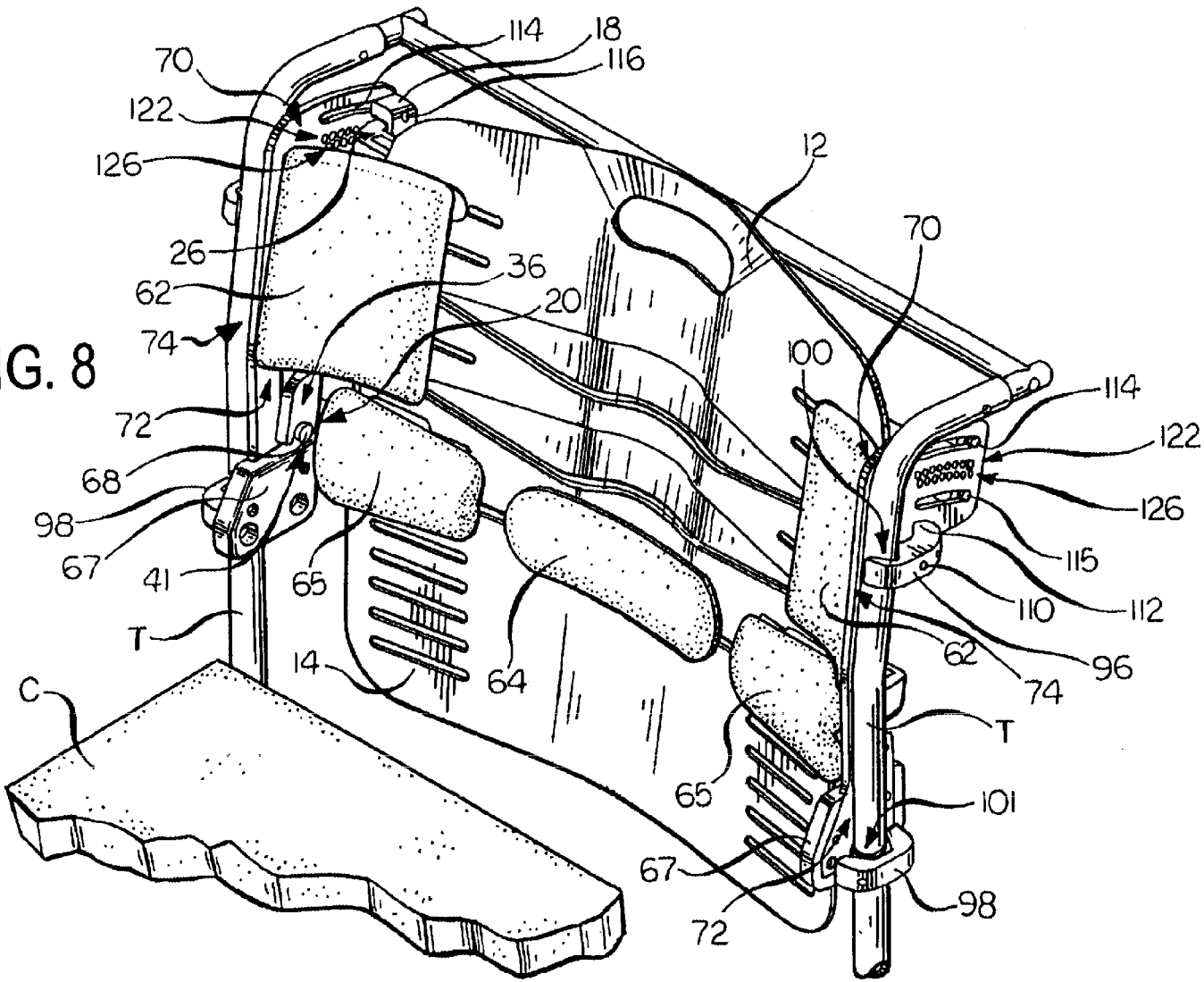
FIG. 8 is a perspective view of the seat back assembly completely attached to wheelchair seat back tubes.

Each upper shell connector 18 is adapted to cooperate with a retainer 66, such as the generally C-shaped retainer shown in FIGS. 7 and 8. Each lower shell connector 20 is adapted to cooperate with a pin 68. The retainer 66 is adapted to be adjustably attached to an upper side plate portion, generally indicated at 70. The pin 68 is attached to a lower side plate portion, generally indicated at 72. The upper and lower side plate portions 70, 72 are preferably portions of a single side plate 74, as shown more clearly in FIGS. 9–12.

The side plates 74 are adapted to be attached to the seat back tubes T. This may be accomplished in any suitable manner. For example, the upper side plate portion 70 may be provided with a threaded aperture (not shown). The lower side plate portion 72 may be provided with two horizontally spaced apertures (also not shown). The threaded apertures are adapted to receive threaded fasteners (not shown). The threaded fasteners are provided for attaching side clamps 96, 98 to the upper and lower side plate portions 70, 72.

In operation, a side plate 74 is placed against an inner surface of each seat back tube T with a minimal portion of the side plate 74 extending forwardly beyond the seat back tube T. An upper portion of each seat back tube T is adapted to be situated between the upper side plate portion 70 and the upper clamp 96. A lower portion of each seat back tube T is adapted to be situated between the lower side plate portion 72 and the lower clamp 98. Each clamp 96, 98 is provided with a relief 100, 101 for receiving a portion of the seat back tube T. Upon tightening the fasteners (not shown), the clamps 96, 98 are drawn towards the side plate portions 70, 72, clamping the seat back tubes T therebetween.

It should be noted that the reliefs 100, 101 are not defined by semi-cylindrical saddle surfaces, like conventional tube clamps. Instead, the reliefs 100, 101 are defined by truncated V-shaped surfaces. The truncated V-shaped surface permits the clamps 96, 98 to be used on various tubes having different dimensions.

It should also be noted that the upper side plate portion 70 shown does not extend forwardly beyond the seat back tubes T. Hence, the upper clamp 96 is not secured to the upper side plate portion 70 by fasteners forward and rearward of the seat back tubes T but rather by a single fastener (not shown) rearward of the seat back tubes T. Hence, the upper clamp 96 has a forwardly disposed relief 100, a centrally located through bore 110, and a rearward cam surface 112. Upon tightening the fastener, the cam surface 112 engages and pivots on the upper side plate portion 70 as a portion of the seat back tube T is drawn into and tightly against the relief 100.

It should be appreciated by one of ordinary skill in the art of the invention that the side plates 74 are adjusted in a substantially vertical direction along the seat back tubes T to align the pin 68 extending from the lower side plate portion 72 with the PSIS of the user. The shell 12 is adapted to be guided into a position where the pins 68 engage the openings 41 (shown in FIG. 6) of the lower shell connectors 20. With the pins 68 engaging the openings 41, the shell 12 is tilted rearward until the coupling element 26 engages the retainer 66.

It should also be appreciated that the tilt or angular disposition of the shell 12 may be adjustable. This may be accomplished in any suitable manner. For example, the upper side plate portion 70 may be provided with holes or slots, such as the vertically spaced upper and lower arcuate shaped fastening slots 114, 115 shown in FIGS. 9–12. The retainer 66 may be provided with vertically spaced upper and lower fastening holes 116, 117 that are adapted to line up with the slots 114, 115. The slots 114, 115 and the holes 116, 117 are adapted to receive fasteners (not shown). The fasteners are provided for attaching the retainer 66 to the upper side plate portion 70. The retainer 66 is adapted to move along an arcuate path that corresponds to the shape of the slots 114, 115. The focal point of the arcuate path is obviously coaxial with the central axis of the pin 68 of each lower shell connector 20.

Once the retainer 66 has been moved to a desired position, or the shell 12 is tilted as desired, the retainer 66 may be secured in a fixed position. The retainer 66 may be secured simply by tightening the fasteners (not shown). However, in a preferred embodiment of the invention, the retainer 66 is slidably attached to the upper side plate portion 70 and a releasable fastener, such as the quick-release, spring-ball locating pin 120 shown in FIG. 7, is provided for securing the retainer 66. The locating pin 120 is adapted to cooperate with co-aligning holes in the retainer 66 and upper side plate portion 70. As shown in the drawings, the upper side plate portion 70 may be provided with a series of adjustment holes, generally indicated at 122, arranged along an arcuate path that correspond to the arcuate paths of the fastening slots 114, 115. An adjustment hole 124 in the retainer 66 may be adapted to align with one of the through holes 31 in the plate 28 of the coupling element 26 (shown in FIG. 5) and further with any one of the adjustment holes 122 in the upper side plate portion 70 to incrementally adjust the position of the retainer 66 and the coupling element 26 engaged therewith. Once the retainer 66 and the coupling element 26 are in a desired position, the locating pin 120 may be inserted through the co-aligned holes 124, 31, 122 to secure the retainer 66 and the coupling element 26 in a fixed position.

In the most preferred embodiment of the invention, two series of through adjustment holes are provided in the upper side plate portion 70, including an upper series of holes 122 and a lower series of holes 126. The upper and lower series of holes 122, 126 are arranged so that the series of holes 122, 126 are vertically spaced along arcuate paths that correspond to the arcuate paths of the fastening slots 114, 115. The retainer 66 is provided with an upper adjustment hole 124 and a lower adjustment hole 128. The retainer 66 provides a suitable location for the adjustment holes 124, 128 between the upper and lower fastening holes 116, 117.

The upper adjustment hole 124 in the retainer 66 is adapted to align with an upper through hole 31 in the plate 28 of the coupling element 26 and further with any one of the upper adjustment holes 122 in the upper side plate portion 70. The lower adjustment hole 128 in the retainer 66 is similarly adapted to align with a lower through hole 31' in the plate 28 of the coupling element 26 and further with any one of the lower adjustment holes 126 in the upper side plate portion 70. As is clearly shown in the drawings, the upper adjustment holes 122 in the upper side plate portion 70 are staggered relatively to the lower adjustment holes 126 in the upper side plate portion 70. Moreover, the adjustment holes 124, 128 in the retainer 66 and the through holes 31, 31' in the plate 28 of the coupling element 26 are arranged diagonally.

In a preferred embodiment of the invention, only one of either of the upper or lower adjustment holes 124, 128 in the retainer 66 and the through holes 31, 31' in the plate 28 of the coupling element 26 are adapted to align with one of the upper or lower holes 122, 126 in the upper side plate portion 70 at a time. In the most preferred embodiment of the invention, the upper series of holes 122 are spaced equidistantly apart to represent certain incremental adjustments and the lower series of holes 126 are spaced equidistantly apart to represent certain other incremental adjustments. For example, the upper series of holes 122 may be spaced two degrees apart from one another and the lower series of holes 126 may be spaced two degrees apart from one another. Moreover, the upper series of holes 122 may be staggered relative to the lower series of holes 126. Accordingly, the upper holes 122 may represent even degree adjustments and the lower holes 126 may represent odd degree adjustments.

Figure 9:
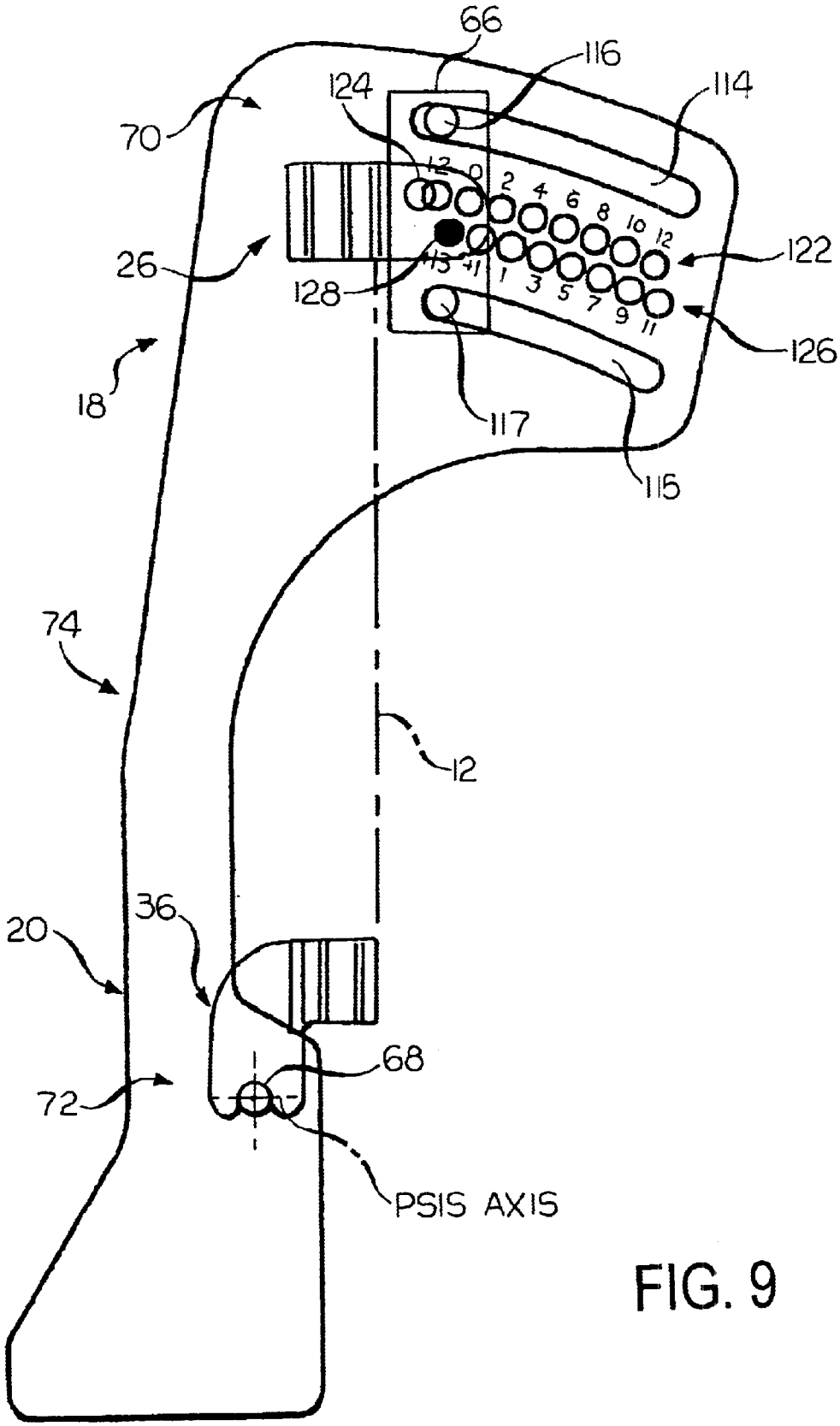
FIG. 9 is an enlarged side elevational view of the seat back of the assembly attached at three degrees anterior.
Figure 10:
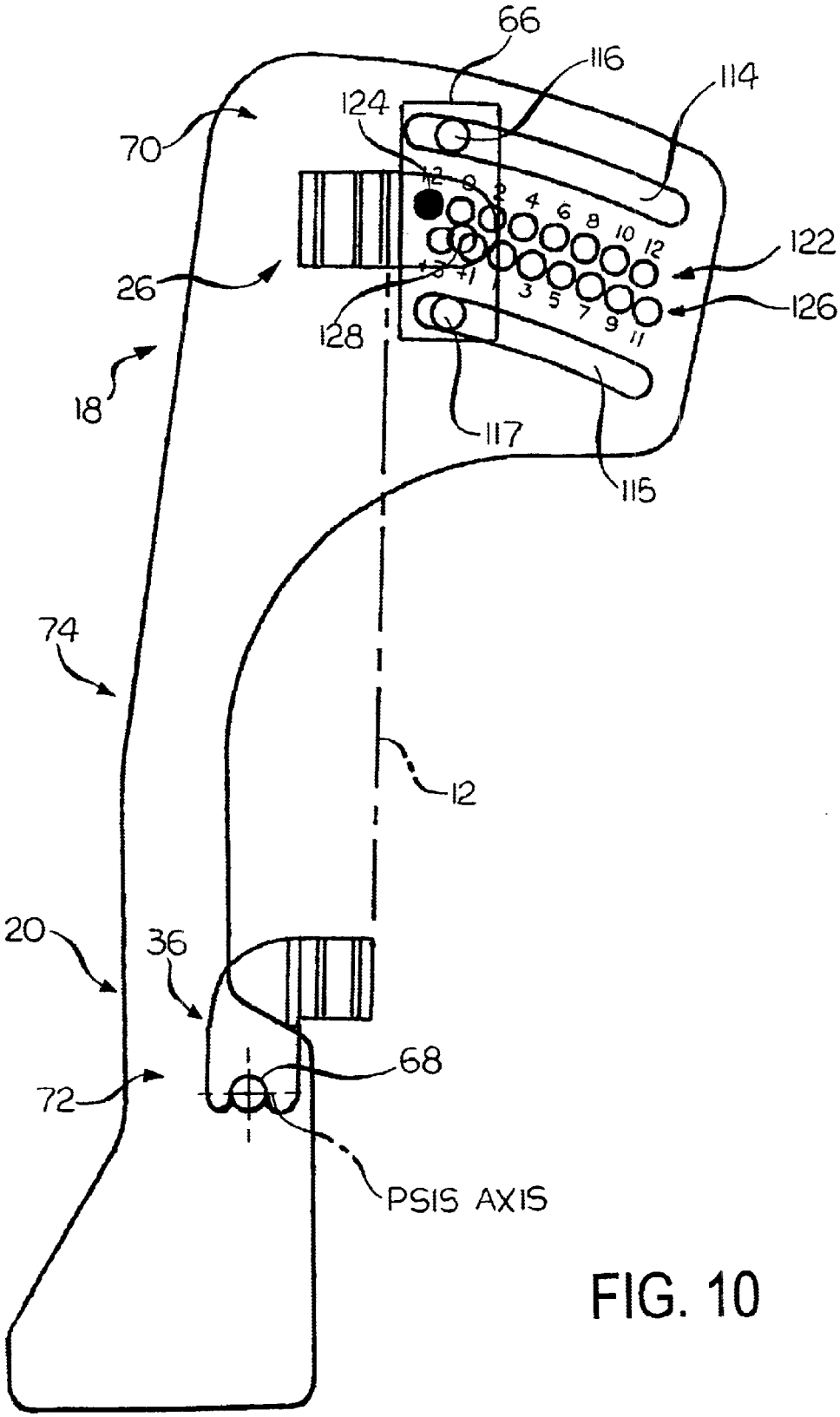
FIG. 10 is an enlarged side elevational view of the seat back of the assembly attached at two degrees anterior.
Figure 11:
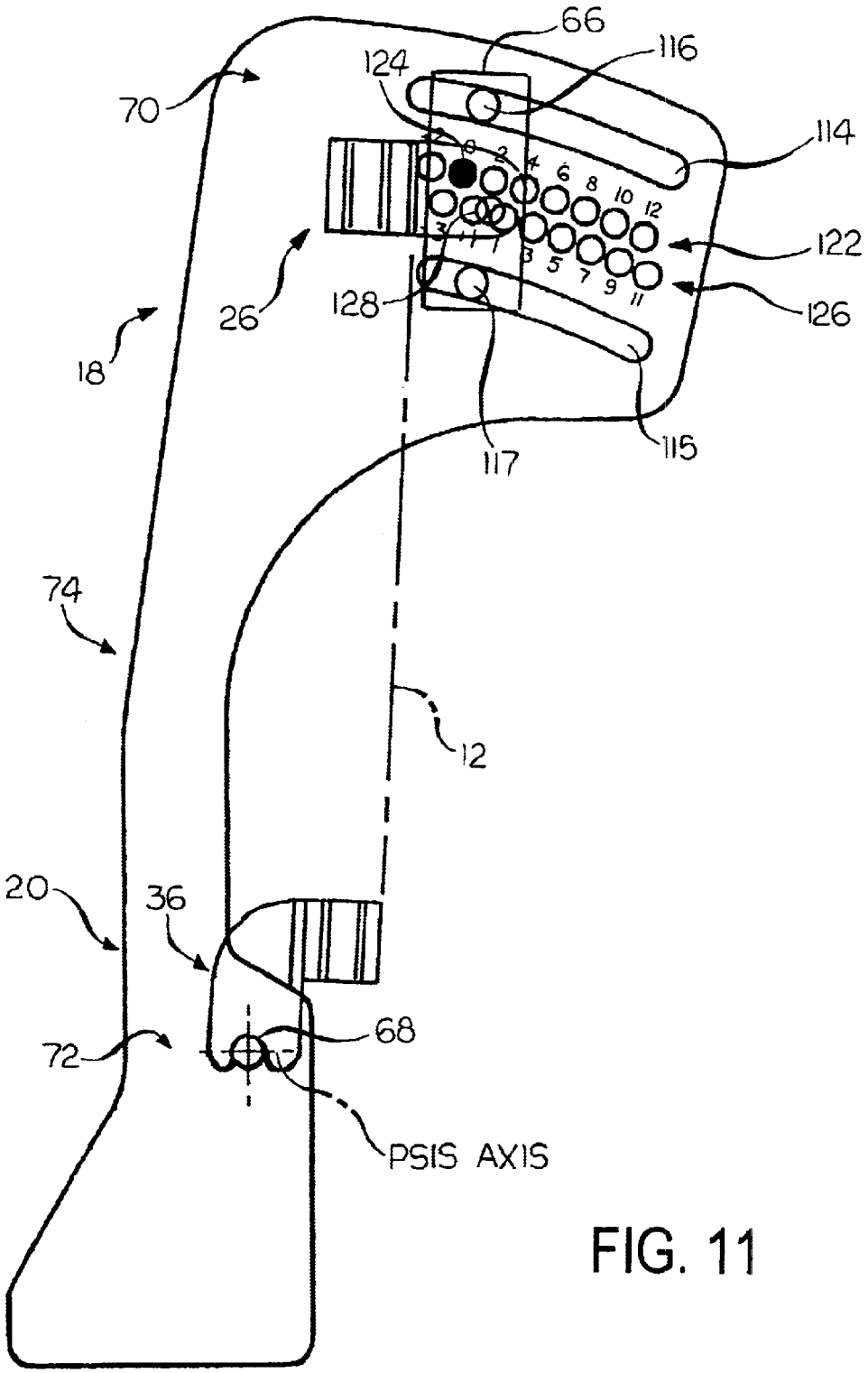
FIG. 11 is an enlarged side elevational view of the seat back of the assembly attached at zero degrees.
Figure 12:
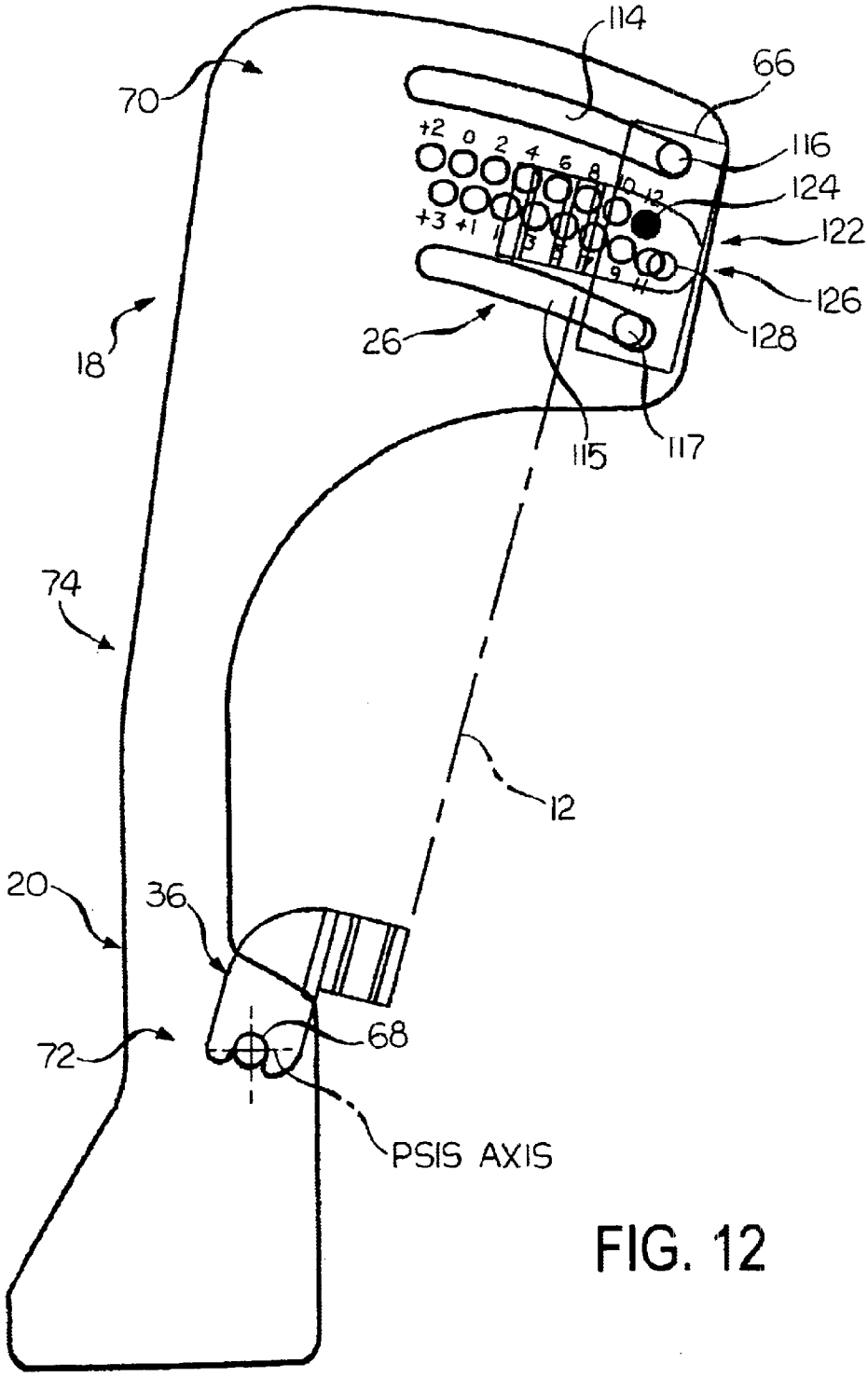
FIG. 12 is an enlarged side elevational view of the seat back of the assembly attached at twelve degrees posterior.

The upper side plate portion 70 may carry indicia for each hole in each series of holes 122, 126 corresponding to the resultant angular disposition of the shell 12 if the locating pin 120 is inserted in that hole. For example, inserting the locating pin 120 through the lower adjustment hole 128 in the retainer 66 and the lower hole 31' in the plate 28 of the coupling element 26 and further through the lower adjustment hole in the upper side plate portion 70 having associated therewith "3" degree indicia, as shown in FIG. 9, tilts the shell 12 three degrees anterior or forward. If the locating pin 120 is inserted through the upper adjustment hole 124 in the retainer 66 and the upper through hole 31 in the plate 28 of the coupling element 26 and further through the upper adjustment hole in the upper side plate portion 70 having associated therewith "2" degree indicia, as shown in FIG. 10, the shell 12 is tilted two degrees anterior. If the locating pin 120 is inserted through the upper adjustment hole 124 in the retainer 66 and the upper through hole 31 in the plate 28 of the coupling element 26 and further through the upper adjustment hole in the upper side plate portion 70 having associated therewith "0" degree indicia, as shown in FIG. 11, the shell 12 is oriented vertically without any angular disposition. This adjustment can proceed with regard to any of the adjustment holes 122, 126 in the upper side plate portion 70. For example, the final adjustment hole in the upper side plate portion 70 opposite the two degree hole is shown to be a hole having associated therewith "12" degree indicia. Inserting the locating pin 120 through the upper adjustment hole 124 in the retainer 66 and the upper through hole 31 in the plate 28 of the coupling element 26 and further through this upper adjustment hole, as shown in FIG. 12, tilts the shell 12 twelve degrees posterior or rearward.

Once the shell 12 is attached to the seat back tubes T, the shell 12 may be outfitted with any desired growth plates 22. Attachment of the growth plates 22 may be accomplished in any suitable manner. For example, the growth plates 22 shown may be attached by inserting fasteners 130, such as the bottom head cap screws shown in FIG. 1, through desired slots 40, 42, 44 and threading the fasteners 130 into apertures in the growth plates 22. Like the shell mounts 24, 34 described above, the slots 40, 42, 44 permit the growth plates 22 to be adjusted vertically and laterally to provide the requisite support for each unique wheelchair and user.

To ensure that the user is properly and comfortably positioned adjacent the seat back assembly 10, the growth plates 22 are preferably covered with foam cushion growth plate pads 62, the cutaway 60 is covered with a foam cushion sacrum pad 64, and the hinges 16 are covered with foam cushion asis pads 65. The lower side plate portions 72 may also be covered with foam cushion side plate pads 67. The foam cushion pads 62, 64, 65, 67 support the user and protect the user against the harsh structure of the growth plates 22, the hinges 16 and the lower side plate portions 72. The pads 62, 64, 65, 67 are preferably formed from a substantially rigid closed-cell foam material as opposed to a soft open-cell foam material. The closed-cell foam material is preferred because it holds its shape longer to provide continued support and protection for the pelvis of the user. The closed-cell foam material may be covered with a fabric material. The closed-cell foam material and fabric material may be formed in a unitary construction.

Once the shell 12 is outfitted with the growth plates 22 and the pads 62, 64, 65, 67 as desired, and the shell 12, the growth plates 22 and pads 62, 64, 65, 67 are preferably covered with a foam overlay pad (not shown). The foam overlay pad is preferably a soft, comfortable foam material. A three-quarter inch foam material would be suitable for carrying out the invention.

The seat back assembly 10 is adapted to be set up as follows. First, the growth plates 22 and the sacrum and asis pads 64, 65, if desired, are attached to the shell 12 and/or the vanity flap 14. The growth plates 22 are attached to the shell 12 and/or the vanity flap 14 at desired elevations by securing the growth plates 22 relative to select vertically spaced slots 40, 44. The growth plates 22 may be adjusted laterally in the slots 40, 44 as desired prior to tightening the fasteners 130 that secure the growth plates 22 to the shell 12 and/or vanity flap 14. Once the growth plates 22 are adjusted to a desired vertical and lateral position, the fasteners 130 may be tightened. With the growth plates 22 secured in place, the growth plates 22 may be covered with growth plate pads 62. Finally, the shell 12 and the vanity flap 14, together with the covered growth plates 22 and the pads 62, 64, 65, 67 may be covered with a cushion overlay pad (not shown).

Next, a user may be seated on the wheelchair seat or seat cushion C and his or her pelvis is adjusted to a desired position. With the pelvis in the desired position, the clamps 96, 98 are clamped to the wheelchair seat back tubes T so that pins 68 extending from the lower side plate portions 72 are brought into co-linear alignment with the PSIS of the user. The shell 12 is oriented so that the openings 41 (shown in FIG. 6) in the lower ends of the coupling elements 36 of the lower shell connectors 20 engage the pins 68. Consequently, the lower shell connectors 20 are located at points proximate the PSIS of the user. This places a lower portion of the shell 12 adjacent the PSIS of the user and the hinges 16 in a proximate co-linear relationship with the pins 68, the lower shell connectors 20 and the user's PSIS. In this way, the lower shell connectors 20 and the pins 68 cooperatively function as locating or targeting members.

Following the adjustment of the clamps 96, 98, the upper coupling element 26 and the retainer 66 may be adjusted relative to the upper side plate portions 70 to orient the shell 12 at a desired angle. The angle of the shell 12 is generally adjusted to the user's comfort. For example, a typical user's line of sight may often be directed downward. This may result from the user's spine being fused in a position that tips the upper torso forward or because of extraneous tissue on the scapula. The angle of the shell 12 may be tilted backward to adjust the user's line of sight.

Once the angle of the shell 12 is adjusted as desired, the angle of the vanity flap 14 may be adjusted out of contact with the gluteal mass or extraneous tissue of the user. This is accomplished by loosing the hinge fasteners 55 (shown in FIG. 4), pivoting the vanity flap 14 relative to the shell 12 to achieve a desired angular relationship between the shell 12 and the vanity flap 14, and then retightening the hinge fasteners 55 to secure the hinge 16 and vanity flap 14 in a substantially fixed position. The vanity flap 14 functions to aid in supporting the sacrum and asis pads 64, 65 and the foam overlay pad. In addition, the vanity flap 14 functions as a flap to cover the gluteal mass or extraneous tissue of the user. For at least this reason, it is preferable that the lower end of the vanity flap 14 be even with or slightly below the seat or seat cushion C to ensure that the extraneous tissue is covered.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A wheelchair comprising:

a seat back tube; and a seat back assembly comprising:

a shell;

a lower shell connector mounted to a lower portion of said shell;

an upper shell connector mounted to an upper portion of said shell; and a side plate separate from the shell and supporting the shell relative to the seat back tube, the side plate comprising:

an upper side plate portion mounted to an upper portion of said seat back tube; and a lower side plate portion mounted to a lower portion of said seat back tube at a position substantially co-linear to the posterior superior iliac spine of a user, said lower shell connector and said lower side plate portion being pivotally engageable with one another along a pivot axis, said upper shell connector and said upper side plate portion being attachable relative to one another at discrete locations so as to permit the angular disposition of said shell to be adjusted.

2. The wheelchair according to claim 1, wherein said lower shell connector includes an opening for receiving a pin extending from said lower side plate portion, said upper shell connector including an upper coupling element that is adapted to engage a retainer attached to said upper side plate portion.

3. The wheelchair according to claim 1, wherein said upper side plate portion is provided with a fastening slot, said upper shell connector being adjustable along said fastening slot.

4. The wheelchair according to claim 1, wherein said upper side plate portion is provided with a series of discrete adjustment holes, said upper shell connector being adjustable relative to each one of said holes.

5. The wheelchair according to claim 1, further including a C-shaped retainer, said upper side plate portion being provided with vertically spaced upper and lower arcuate shaped fastening slots, said retainer being slidably attached to said upper side plate portion by fasteners engaging said fastening slots, said upper shell connector being engageable with said retainer, said upper shell connector being adjustable along an arcuate path relative to said upper side plate portion by adjusting the position of said retainer along said arcuate shaped fastening slots, the arcuate path having a focal point that is coaxial with the pivot axis.

6. The wheelchair according to claim 5, wherein said upper shell connector includes an upper coupling element engageable with said retainer, said upper side plate portion further having an upper series of discrete adjustment holes, said upper coupling element and said retainer each having an upper adjustment hole, said upper adjustment holes in said upper coupling element and said retainer being adapted to align with any one of said discrete adjustment holes, said aligned adjustment holes being adapted to receive a releasable locking pin.

7. The wheelchair according to claim 6, wherein said upper side plate portion further has a lower series of discrete adjustment holes, said upper coupling element and said retainer each further having a lower adjustment hole, said lower adjustment holes in said upper coupling element and said retainer being adapted to align with any one of said lower discrete adjustment holes, said aligned adjustment holes being adapted to receive said releasable locking pin.

8. The wheelchair according to claim 7, wherein said upper series of discrete adjustment holes are arranged two degrees apart along the arcuate path and said lower series of discrete adjustment holes are arranged two degrees apart along the arcuate path.

9. The wheelchair according to claim 8, wherein said upper and lower series of discrete adjustment holes are further arranged so that one of said upper and lower series of discrete adjustment holes provides even degree incremental adjustments and the other one of said upper and lower series of discrete adjustment holes provides odd degree incremental adjustments.

10. The wheelchair according to claim 1, further including a vanity flap pivotally connected to said shell, said vanity flap being adapted to be secured in a substantially fixed position.

11. The wheelchair according to claim 10, wherein said vanity flap is pivotally connected to said shell by a hinge adapted for positioning proximate the posterior superior iliac spine of the user.

12. The wheelchair according to claim 10, wherein each said shell and said vanity flap has a concave contour.

13. The wheelchair according to claim 10, further including cutaway portions in said shell and said vanity flap to reduce the risk of said shell and said vanity flap contacting one another throughout movement of said shell and said vanity flap.

* * * * *